US007588097B2

(12) United States Patent
Kamegai et al.

(10) Patent No.: US 7,588,097 B2
(45) Date of Patent: Sep. 15, 2009

(54) POWER IMPACT TOOL

(75) Inventors: Hikaru Kamegai, Anjo (JP); Kiyonobu Yoshikane, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/892,087

(22) Filed: Aug. 20, 2007

(65) Prior Publication Data

US 2008/0047723 A1 Feb. 28, 2008

(30) Foreign Application Priority Data

Aug. 24, 2006 (JP) ..... 2006-228231
Jul. 6, 2007 (JP) ..... 2007-178594

(51) Int. Cl.
*B25D 17/00* (2006.01)

(52) U.S. Cl. ..... 173/162.1; 173/48; 173/201; 173/109; 173/170; 173/162.2; 173/217

(58) Field of Classification Search ..... 173/48, 173/162.1, 201, 109, 162.2, 170, 217
See application file for complete search history.

(56) References Cited

U.S. PATENT DOCUMENTS 4,478,293 A * 10/1984 Weilenmann et al. .... 173/162.2
4,991,664 A * 2/1991 Kolgan et al. ..... 173/201
6,112,830 A 9/2000 Ziegler et al.
7,096,973 B2 * 8/2006 Ikuta et al. ..... 173/201
7,252,157 B2 * 8/2007 Aoki ..... 173/162.2
7,331,407 B2 * 2/2008 Stirm et al. ..... 173/201
2004/0206520 A1 * 10/2004 Ikuta ..... 173/48

FOREIGN PATENT DOCUMENTS

EP 1 000 712 A2 5/2000

* cited by examiner

*Primary Examiner*—Rinaldi I. Rada
*Assistant Examiner*—Michelle Lopez
(74) *Attorney, Agent, or Firm*—Oliff & Berridge, PLC

(57) ABSTRACT

It is an object of the invention to provide a technique for further improving the vibration reducing performance in a power impact tool that linearly drives a tool bit by using a swinging mechanism. According to the invention, a representative power impact tool is provided with a motor, a rotating shaft, a swinging member, a tool driving mechanism and a counter weight. The swinging member is supported by the rotating shaft to swing in the axial direction of the rotating shaft by rotation of the rotating shaft. The counter weight is disposed in a region higher than a lower end region of the swinging member in the vertical direction to intersect with the axis of the rotating shaft, and a lower end of the counter weight is connected to the lower end region of the swinging member. The counter weight extends upward from the connection between the counter weight and the swinging member and has a pivot point in the extending end portion, and when the swinging member swings, the counter weight is driven by the swinging member to rotate in the axial direction of the tool bit, thereby reducing vibration caused in the axial direction of the tool bit.

11 Claims, 12 Drawing Sheets

POWER IMPACT TOOL

BACKGROUND OF THE INVENTION

1. Field of the Invention

The present invention relates to a technique for reducing vibration in a power impact tool that linearly drives a tool bit in its longitudinal direction by a swinging mechanism 2. Description of the Related Art A technique for reducing or alleviating vibration caused in an electric hammer drill with a swinging mechanism is disclosed in EP1000712. According to the known art, the swinging mechanism includes a swinging ring swinging in the axial direction of a rotating shaft by rotation of the rotating shaft driven by a motor. A tool bit is linearly driven by a tool driving mechanism connected to an upper end region of the swinging ring. In a vibration reducing mechanism in this known technique, a counter weight is connected to the lower end region in a position shifted about 180° in the circumferential direction from the connection between the swinging ring and the tool driving mechanism. The counter weight linearly moves by the swinging movement of the swinging ring and thereby reduces vibration caused during the operation.

The counter weight is disposed in a lower region apart from the swinging ring. Therefore, the vertical distance between the path of travel of the counter weight and the axis of the hammer bit is widened. As a result, when the tool driving mechanism and the counter weight are driven by the swinging ring, unnecessary vibration is caused by a couple around the horizontal axis that intersects with the axis of the rotating shaft. Further, because the counter weight linearly moves by the swinging movement of the swinging ring, loss of a striking energy of the tool bit may be caused by resistance of the sliding area.

SUMMARY OF THE INVENTION

Accordingly, it is an object of the invention to provide a technique for further improving the vibration reducing performance in a power impact tool that linearly drives a tool bit by using a swinging mechanism.

Above described object is achieved by a claimed invention. According to the invention, a representative power impact tool performs a predetermined operation on a workpiece by striking movement of a tool bit in its axial direction. The power impact tool includes a motor, a rotating shaft, a swinging member and a tool driving mechanism. The rotating shaft is disposed parallel to the axial direction of the tool bit and rotationally driven by the motor. The swinging member is supported by the rotating shaft and caused to swing in the axial direction of the rotating shaft by rotation of the rotating shaft. The tool driving mechanism is connected to an upper end region of the swinging member in the vertical direction that intersects with the axis of the rotating shaft. The tool driving mechanism is caused to linearly move in the axial direction of the tool bit by the swinging movement of the swinging member and linearly drives the tool bit.

According to the invention, a counter weight that reduces vibration caused in the axial direction of the tool bit during the operation is provided. The counter weight is disposed in a region higher than a lower end region of the swinging member in the vertical direction that intersects with the axis of the rotating shaft. Further, a lower end of the counter weight is connected to the lower end region of the swinging member. The counter weight extends upward from the connection between the counter weight and the swinging member and has a pivot point in the extending end portion. When the swinging member swings, the counter weight is driven by the swinging member and caused to rotate in the axial direction of the tool bit, thereby reducing vibration caused in the axial direction of the tool bit.

The manner of "higher than a lower end region" according to the invention may typically be defined by a state in which the center of gravity of the counter weight is located in a region higher than the lower end region of the swinging member. For example, the counter weight may be disposed between the lower end region and the upper end region of the swinging member, the counter weight may extend in a region lower than the lower end region of the swinging member, or the counter weight may end in a region higher than the upper end region of the swinging member.

The counter weight according to the invention may preferably be configured to be disposed on the outside of the swinging member in such a manner as to avoid interface with the swinging member. Preferably, the counter weight may generally U-shaped having an open top.

The counter weight is disposed in a region higher than the lower end region of the swinging member and connected to the lower end region of the swinging member. With this construction, the counter weight located nearer to the axis of the tool bit can be driven by the swinging member. Further, the vibration reducing function of the counter weight can be performed in an optimum manner by adjusting the timing at which the swinging member drives the counter weight so as to correspond to the timing of vibration caused during the operation. According to the invention, the counter weight is moved in a position nearer to the axis of the tool bit, so that unnecessary vibration by couple force can be reduced.

Further, according to the invention, because the counter weight rotates, the sliding resistance can be reduced and energy loss can be avoided or reduced. Further, compared with the known construction in which the counter weight is designed to linearly move, the supporting structure of the counterweight can be made simpler.

As another aspect of the invention, the pivot point of the counter weight may be located at a position higher than the axis of the tool bit. By such construction, the vertical displacement during rotation of the counter weight can be reduced. As a result, the occurrence of unnecessary vertical vibration can be reduced.

As another aspect of the invention, the counter weight may include a connecting part connected to the swinging member and extending upward and a weight part seeing as vibration reducing weight. Further, the connecting part and the weight part may be provided as separate members and thereafter integrally formed with each other. Therefore, in manufacturing the counter weight the shapes and configurations of the connecting part and the weight part can be properly set based on individual functions. Specifically, the connecting part can be easily formed as a thin plate member, for example, by sheet metal processing, and the weight part can also be easily formed into a block, for example, as a casting. As a result, the manufacturing cost can be reduced.

Further, while the weight required to reduce vibration is ensured on the weight part side, the connecting part can be made thinner, for example, by sheet metal processing. Thus, the counter weight can be reduced in weight as a whole, and the mass of the component parts other than the weight part can be reduced in weight. Therefore, the occurrence of unnecessary vibration by the movement of the counter weight can be reduced.

As another aspect of the invention, the connecting part may include right and left arms with respect to the longitudinal axis of the tool to extend upward from the lower end connected to the swinging member and past the side of the swinging member. The lateral distance between the extending end portions of the arms can be changed by elastic deformation of the arms. Further, the pivot point may include a stem that extends in a direction that intersects with the extending direction of the arms and a hole that is fitted onto the stem for relative rotation. One of the stem and the hole may be formed in the extending end portion of each of the arms, and the stem and the hole are engaged with each other by utilizing a movement of changing the distance between the arms by-deformation of the arms.

According to such construction, the stem and the hole are engaged with each other by utilizing a movement of changing the distance between the arms by deformation of the arms.

As another aspect of the invention, the power impact tool may further include a dynamic vibration reducer that reduces vibration caused during the operation of the tool bit. The dynamic vibration reducer may include a weight that is allowed to reciprocate in the axial direction of the tool bit with a biasing force of an elastic element being applied to the weight. The counter weight drives the weight of the dynamic vibration reducer via the elastic element when the counter weight rotates. With both the vibration reducing functions of the counter weight and the dynamic vibration reducer, a further higher vibration reducing effect can be obtained. Further, with the construction in which the weight of the dynamic vibration reducer is driven by utilizing rotation of the counter weight driven by the swinging member, it is not necessary to additionally provide a driving mechanism specifically designed for driving the weigh, so that simplification in structure can be realized.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power impact tools and method for using such power impact tools and devices utilize therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Representative Embodiment

Figure 1:
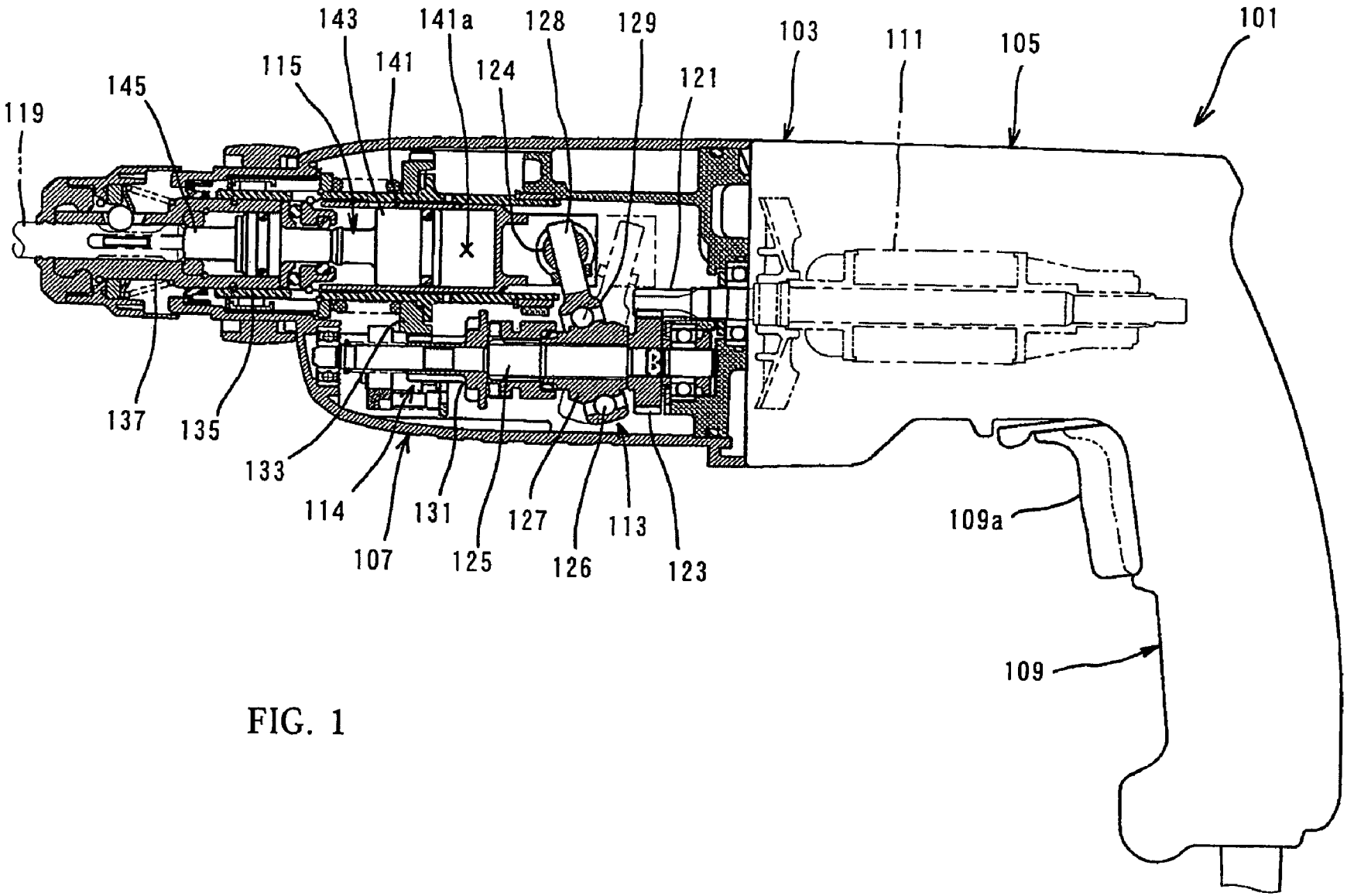
FIG. 1 is a side view, partly in section, schematically showing an entire electric hammer drill according to a fist representative embodiment of the invention.

First representative embodiment of the present invention will now be described with reference to FIGS. 1 to 4. As shown in FIG. 1, an electric hammer drill 101 as a representative embodiment of the power impact tool according to the present invention comprises a body 103 and a hammer bit 119 detachably coupled to the tip end region of the body 103 via a tool holder 137. The hammer bit 119 is a feature that corresponds to the "tool bit" according to the present invention.

The body 103 includes a motor housing 105, a gear housing 107 and a handgrip 109. The motor housing 105 houses a driving motor 111. The gear housing 107 houses a motion converting mechanism 113, a power transmitting mechanism 114 and a striking mechanism 115. The driving motor 111 is a feature that corresponds to the "motor" according to the present invention. The rotating output of the driving motor 111 is appropriately converted into linear motion via the motion converting mechanism 113 and transmitted to the striking element 115. Then, an impact force is generated in the axial direction of the hammer bit 119 via the striking mechanism 115. Further, the speed of the rotating output of the driving motor 111 is appropriately reduced by the power transmitting mechanism 114 and then transmitted to the hammer bit 119. As a result, the hammer bit 119 is caused to rotate in the circumferential direction. The driving motor 111 is started by depressing a trigger 109*a* disposed on the handgrip 109. In the description hereinafter, the side of the hammer bit 119 is taken as the front side, and the side of the handgrip 109 as the rear side.

The motion converting mechanism 113 includes a driving gear 121 that is rotated in a vertical plane by the driving motor 111, a driven gear 123 that engages with the driving gear 121, a rotating element 127 that rotates together with the driven gear 123 via an intermediate shaft 125, a swinging ring 129 that is caused to swing in the axial direction of the hammer bit 119 by rotation of the rotating element 127, and a cylindrical piston 141 that is caused to reciprocate by swinging movement of the swinging ring 129. The intermediate shaft 125 and the swinging ring 129 are features that correspond to the "rotating shaft" and the "swinging member", respectively, according to the present invention. The intermediate shaft 125 is disposed parallel (horizontally) to the axial direction of the hammer bit 219. The outer surface of the rotating element. 127 fitted onto the intermediate shaft 125 is inclined at a predetermined angle with respect to the axis of the intermediate shaft 125. The swinging ring 129 is supported on the inclined outer surface of the rotating element 127 via a bearing 126 such that it can rotate with respect to the rotating element 127. When the rotating element 127 rotates, the swinging ring 129 is caused to swing in the axial direction of the hammer bit 119 and in a direction that intersects with this axial direction. The rotating element 127 and the swinging ring 129 rotatably supported on the rotating element 127 via the bearing 126 form a swinging mechanism.

Further, a swinging rod 128 is formed in the upper end region of the swinging ring 129 and extends upward (in the radial direction) from the swinging ring 129. The swinging rod 128 is loosely fitted in an engaging member 124 that is formed in the rear end portion of the cylindrical piston 141. The cylindrical piston 141 is slidably disposed within a cylinder 135 and driven by the swinging movement (a component in the axial direction of the hammer bit 119) of the swinging ring 129 so that it reciprocates along the cylinder 135.

The striking mechanism 115 includes a striker 143 and an impact bolt 145. The striker 143 is slidably disposed within the bore of the cylindrical piston 141. The impact bolt 145 is slidably disposed within the tool holder 137 and is adapted to transmit the kinetic energy of the striker 143 to the hammer bit 119. The striker 143 is driven by the action of an air spring caused within an air chamber 141*a* of the cylindrical piston 141 by means of sliding movement of the piston 141. Then, the striker 143 collides with (strikes) the impact bolt 145 slidably disposed within the tool holder 137 and transmits the striking force to the hammer bit 119 via the impact bolt 145. The cylindrical piston 141, the striker 143 and the impact bolt 145 are features that correspond to the "tool driving mechanism" according to the inventor.

The power transmitting mechanism 114 includes a first transmission gear 131 that is caused to rotate in a vertical pane by the driving motor 111 via the driving gear 121 and the intermediate shaft 125, a second transmission gear 133 that engages with the first transmission gear 131, a cylinder 135 that is cased to rotate together with the second transmission gear 133. The rotation driving force of the cylinder 135 is transmitted to the tool holder 137 and fit to the hammer bit 119 supported by the tool holder 137.

Figure 2:
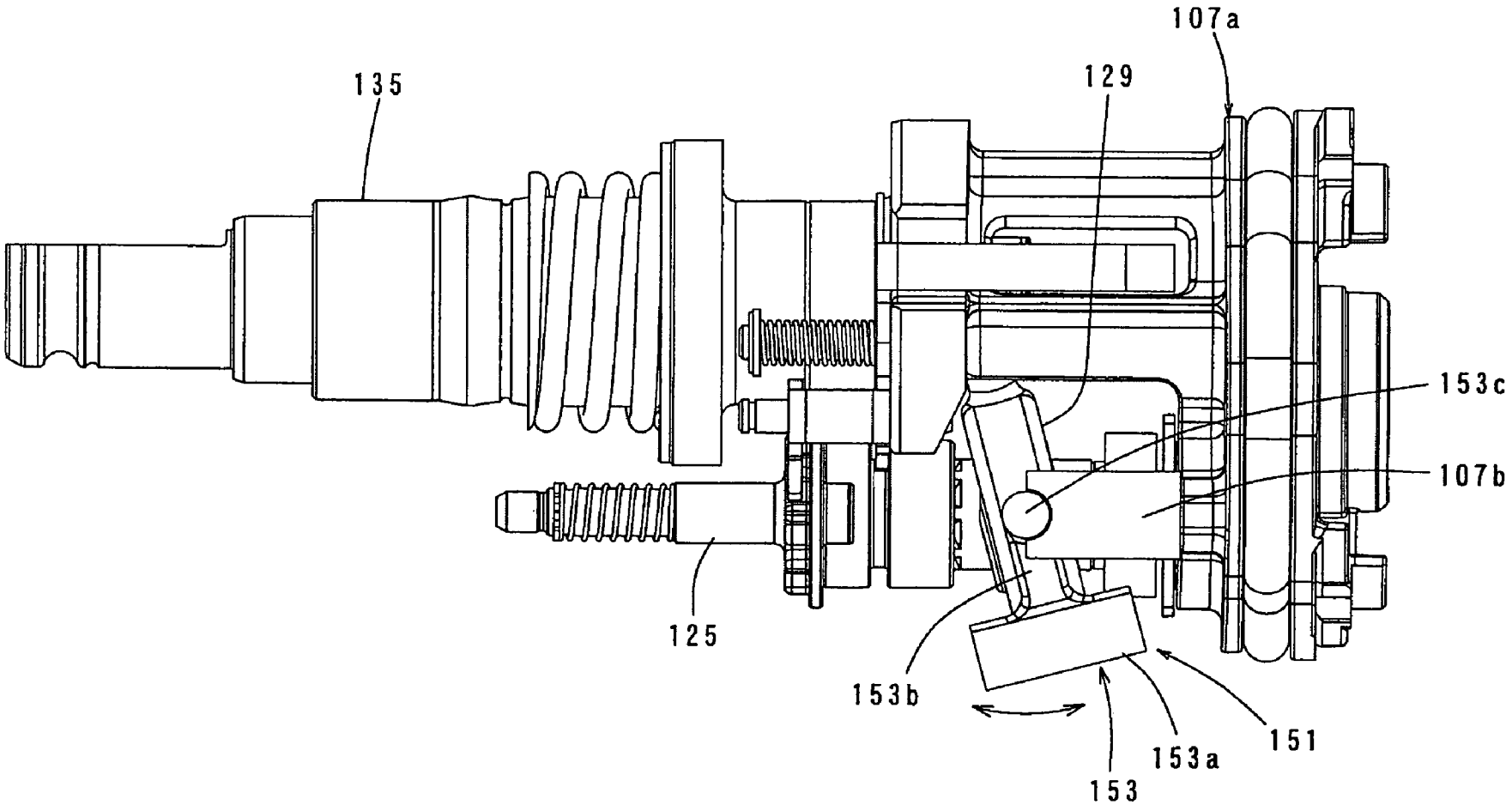
FIG. 2 is a side view showing an internal mechanism within a gear housing.
Figure 3:
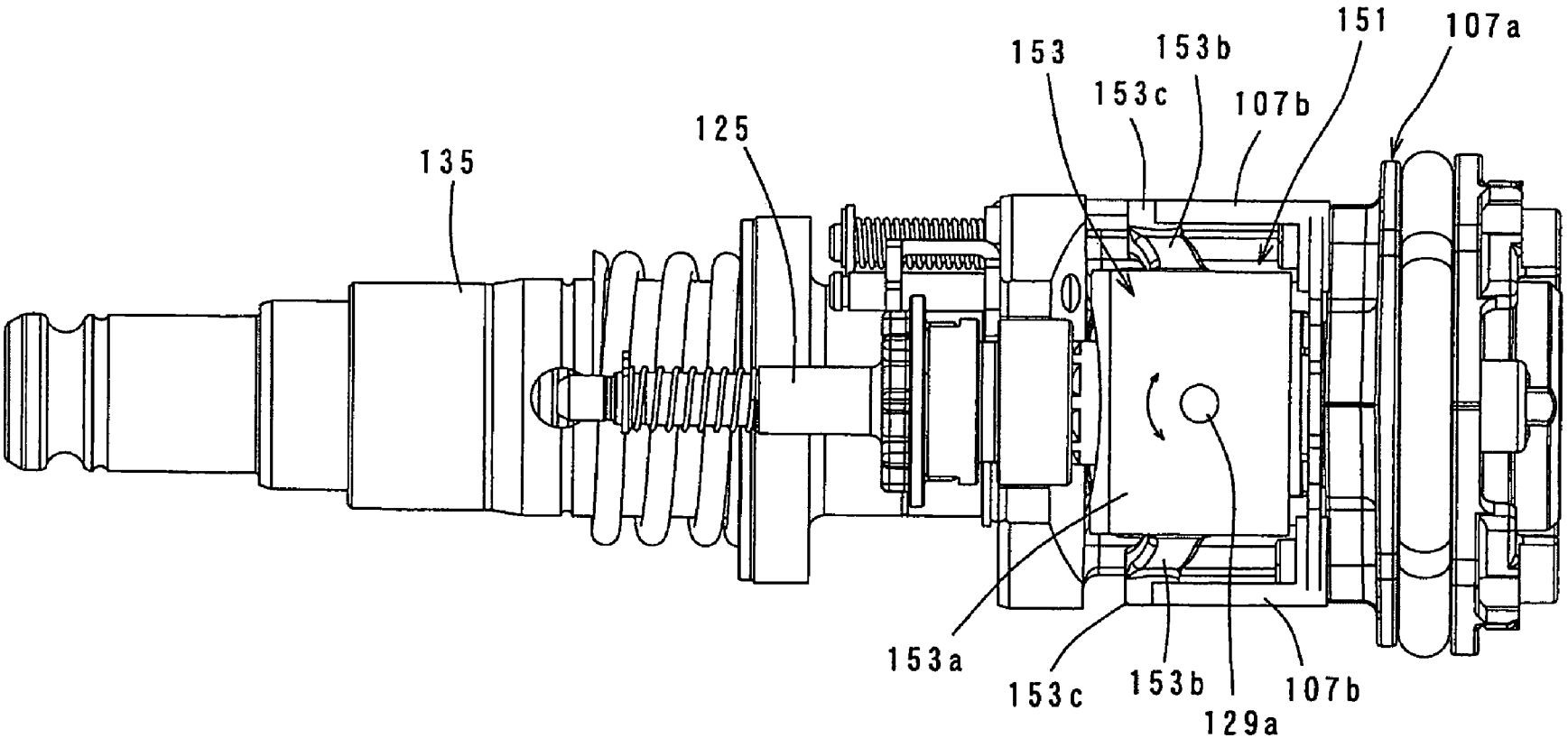
FIG. 3 is a bottom view also showing the internal mechanism with the gear housing.
Figure 4:
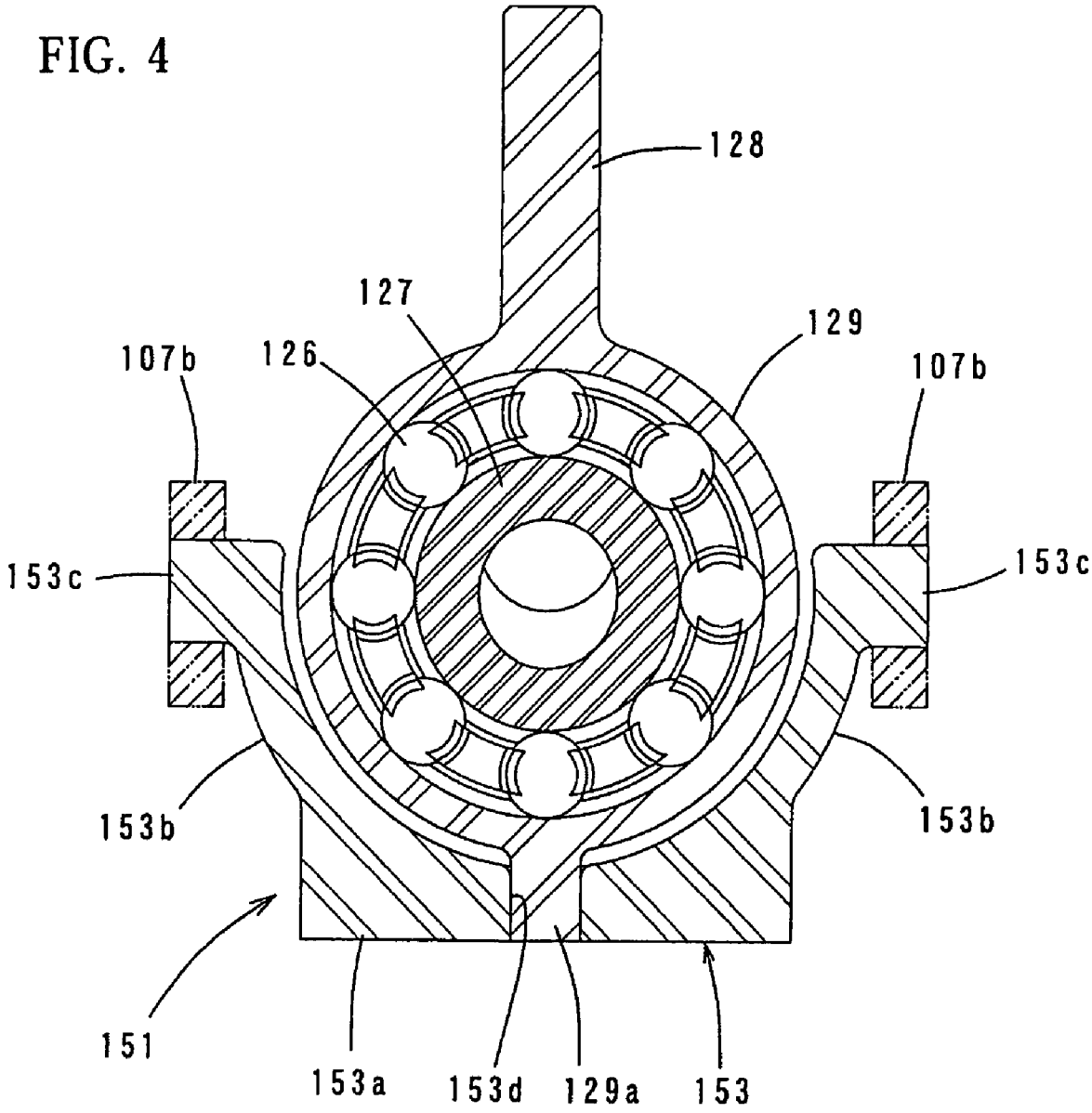
FIG. 4 is a sectional view showing a vibration reducing mechanism part.

A vibration reducing mechanism 151 will now be described with reference to FIGS. 2 to 4. The vibration reducing mechanism 151 is provided to reduce impulsive and cyclic vibration caused in the axial direction of the hammer bit 119 dig processing operation using the hammer drill 101. FIGS. 2 and 3 show an internal mechanism disposed within the gear housing 107. FIG. 2 is a side view and FIG. 3 is a bottom view. Further, FIG. 4 is a sectional view showing a vibration reducing mechanism part. The vibration reducing mechanism 151 of this embodiment includes a counter weight 153 which is driven by the swinging ring 129. The counter weight 153 is a feature that corresponds to the "counter weight" according to the invention.

As shown in FIG. 4, the counter weight 153 is generally U-shaped having an open top, as viewed from the front or the back of the hammer drill 101. The counterweight 153 is disposed on the outside of the swinging ring 129 in such a manner as to cover generally the lower half of the swinging ring 129. The counter weight 153 has a generally rectangular lower end portion 153*a* (the bottom of the U shape) (see FIG. 3) as viewed from under the hammer drill 101. Right and left elongate arms 153*b* extend upward from the lower end portion 153*a*. The weights of the lower end portion 153*a* and the arms 153*b* are set such that the center of gravity of the counter weight 153 is located above the lower end region of the swinging ring 129. The arms 153*b* of the counter weight 153 extend to about the same level as a horizontal plane including the axis of the intermediate shaft 125. A stem 153*c* is formed on the extending end of each of the arms 153*b* and protrudes generally horizontally outward. The stem 153*c* is rotatably supported by a front support plate (not shown) on the gear housing 107 and a rear support plate 107*b* (see FIGS. 2 and 3) fixedly disposed on an inner housing 107*a* of the gear housing 107. Specifically, the counter weight 153 is supported in a suspended manner by the front and rear support plates 107*b* which are butted to each other. Thus, the counter weight 153 can rotate on the stem 153*c* in the axial direction of the hammer bit 119.

A cylindrical protrusion 129*a* is provided in the lower end region of the swinging ring 129 or in a position shifted about 180° in the circumferential direction from the connection between the swinging ring 129 and the cylindrical piston 141. Correspondingly, an engagement hole 153*d* is formed in the lower end portion 153*a* of the counter weight 153. The protrusion 129*a* of the swinging ring 129 is loosely engaged in the engagement hole 153*d* for free relative movement. Therefore, when the swinging ring 129 swings, the counter weight 153 is driven by the swinging movement (a component of movement in the axial direction of the hammer bit 119) of the swinging ring 129 and is caused to rotate in a direction opposite to the direction of the reciprocating movement of the cylindrical piston 141. Further, a clearance is provided between the inner surface of the counter weight 153 and the outer surface of the swinging ring 129 such that the counter weight 153 can rotate without interfering with the swinging ring 129.

Operation of the hammer drill 101 of the first embodiment constructed as described above will now be explained. When the driving motor 111 (shown in FIG. 1) is driven, the rotating output of the driving motor 111 causes the driving gear 121 to rotate in a vertical plane. When the driving gear 121 rotates, the rotating element 127 is caused to rotate in a vertical plane via the driven gear 123 that engages with the driving gear 121 and the intermediate shaft 125. Then, the swinging ring 129 and the swinging rod 128 swing, and the cylindrical piston 141 is caused to linearly slide by the swinging movement of the swinging rod 128. By the action of the air spring function within the air chamber 141*a* of the cylindrical piston 141 as a result of this sliding movement of the cylindrical piston 141, the striker 143 reciprocates within the cylindrical piston 141.

At this time, the striker 143 collides with the impact bolt 145 and transmits the kinetic energy caused by the collision to the hammer bit 119.

When the first transmission gear 131 is caused to rotate together with the intermediate shaft 125, the cylinder 135 is caused to rotate in a vertical plane via the second transmission gear 133 that engages with the first transmission gear 131, which in turn causes the tool holder 137 and the hammer bit 119 held by the tool holder 137 to rotate together with the cylinder 135. Thus, the hammer bit 119 performs a hammering movement in the axial direction and a drilling movement in the circumferential direction, so that the processing operation (drilling operation) is performed on the workpiece.

The hammer drill 101 can be switched not only to hammer drill mode in which the hammer bit 119 performs a hammering movement and a drilling movement in the circumferential direction, but to drilling mode in which the hammer bit 119 performs only a drilling movement or to hammering mode in which the hammer bit 119 performs only a hammering movement.

In the above-described processing operation, the counter weight 153 reduces impulsive and cyclic vibration caused in the axial direction of the hammer bit 119. The counter weight 153 is connected to the swinging ring 129 in a position shifted about 180° from the connection between the swinging ring 129 and the cylindrical piston 141 in the circumferential direction. Therefore, when the cylindrical piston 141 slides within the cylinder 135 toward the striker 143, the counter weight 153 rotates in a direction opposite to the sliding direction of the striker 143. Specifically, according to this embodiment, when the cylindrical piston 141 linearly moves toward the striker 143, and the hammer bit 119 is caused to perform a striking movement via the striker 143 and the impact bolt 145, the counter weight 153 rotates on the stem 153*c* in the axial direction of the hammer bit 119 and in a direction opposite to the cylindrical piston 141. In this manner, vibration cause in the hammer drill 101 in the axial direction of the hammer bit 119 can be reduced.

According to this embodiment, the counter weight 153 is disposed in a region higher than the lower end region of the swinging ring 129 and with this construction, the center of gravity of the counter weight 153 can be located nearer to the axis of the hammer bit 119 compared with the known art. As a result, unnecessary vibration can be reduced which may be caused by a couple around the horizontal axis that intersects with the axis of the intermediate shaft 125 when the cylindrical piston 141 and the counter weight 153 are driven by the swinging ring 129 in opposite directions.

Further, according to this embodiment, the counter weight 153 rotates in the axial direction of the hammer bit 119 on the stems 153*c* on the extending ends of the upwardly extending arms 153. The counter weight 153 is thus caused to rotate by the swinging movement of the swinging ring 129. Therefore, the sliding resistance of the sliding area can be reduced, so that loss of the driving force of sting the hammer bit 119 can be avoided or reduced. Further, the structure of supporting the counter weight 153 is formed by the stems 153*c* and the front and rear support plates 107*b* that rotatably support the stems 153*c*. Thus, the structure of supporting the counter weight 153 can be made simpler, compared with the construction in which the counter weight 153 reciprocates.

Further, in this embodiment the structure of connecting the counter weight 153 and the swinging ring 129 is realized by the construction in which the protrusion 129*a* of the swinging ring 129 is loosely engaged in the engagement hole 153*d* for free relative movement. Therefore, the lateral swinging movement of the swinging ring 129, or the swinging movement (shown by the arrow in FIG. 3) of the swinging ring 129 on the vertical axis perpendicular to the axis of the intermediate shaft 125 is not transmitted to the counter weight 153. Therefore, unnecessary vibration can be prevented from being caused around the vertical axis by driving of the counter weight 153.

Second Representative Embodiment

Figure 5:
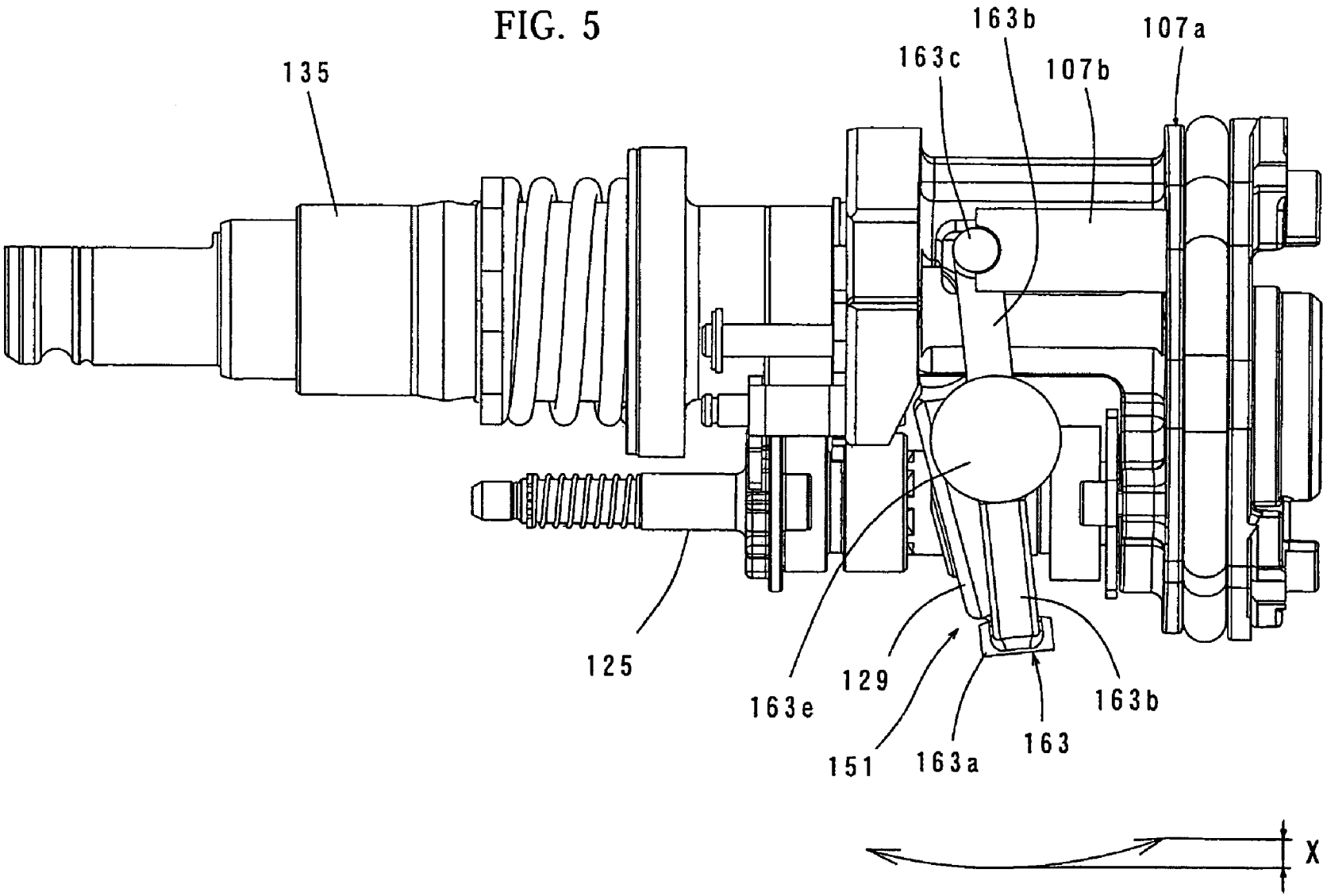
FIG. 5 is a side view showing an internal mechanism within the gear housing according to a second representative embodiment of the invention.
Figure 6:
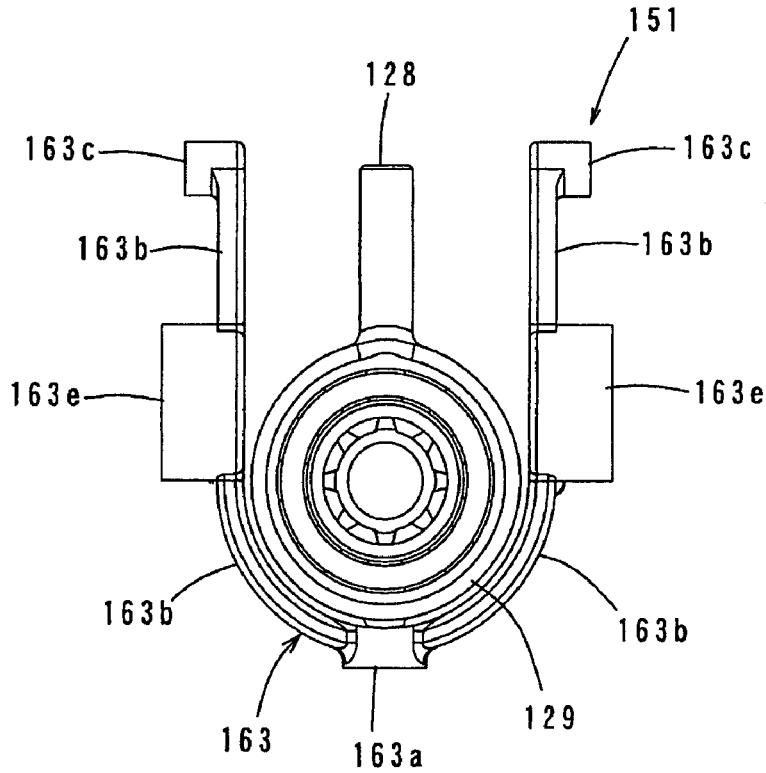
FIG. 6 is an external view of the vibration reducing mechanism part.
Figure 7:
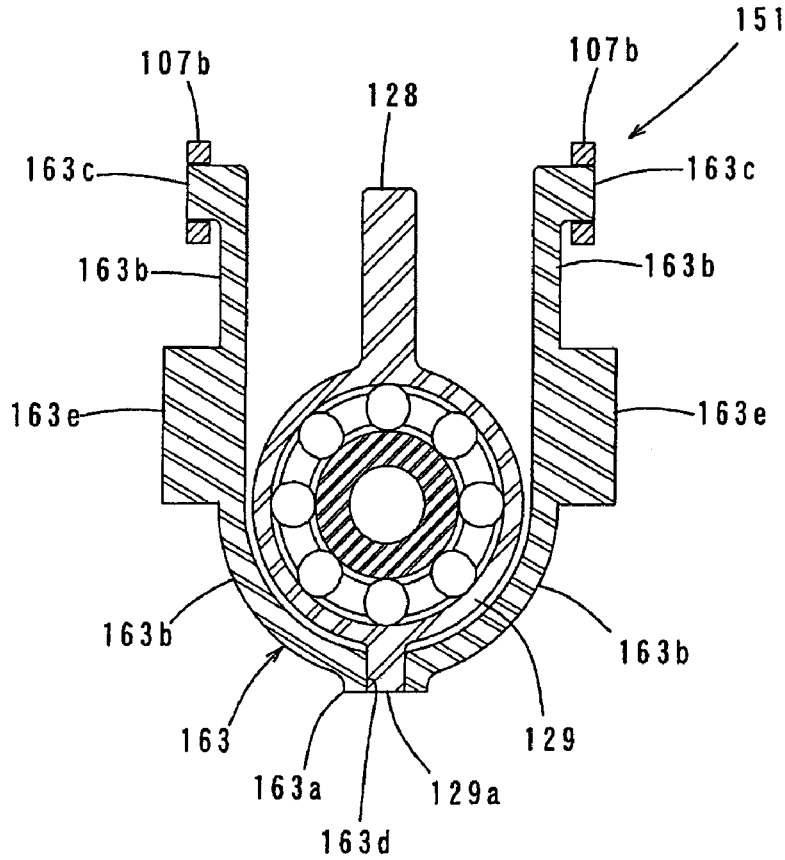
FIG. 7 is a sectional view of the vibration reducing mechanism part.

Now, the vibration reducing mechanism 151 according to a second representative embodiment of the present invention is explained with reference to FIGS. 5 to 7. FIG. 5 shows an internal mechanism disposed within the gear housing 107. FIG. 6 is an external view of the vibration reducing mechanism part, and FIG. 7 is a sectional view of the vibration reducing mechanism part. Like in the fist embodiment, the vibration reducing mechanism 151 of the second embodiment also includes a counter weight 163 which is driven by the swinging ring 129. The pivot point of the counter weight 163 is located at a higher position than in the first embodiment. Except this point, the second embodiment has the same construction as the first embodiment. Components or elements in the second embodiment which are substantially identical to those in the first embodiment are given like numerals as in the first embodiment and will not be described. The counter weight 163 is a feature that corresponds to the "counter weight" according to the present invention.

As shown in FIGS. 6 and 7, the counter weight 163 is generally U-shaped having an open top, as viewed from the front or the back of the hammer drill 101. The counter weight 163 is disposed on the outside of the swinging ring 129. The counter weight 163 is connected to the swinging ring 129 at a lower end portion 163*a* (the bottom of the U shape) of the counter weight 163 via the protrusion 129*a* of the swinging ring 129 and an engagement hole 163*d*. Right and left arms 163*b* extend upward from the lower end portion 163*a*.

The arms 163*b* of the counter weight 163 extend upward to a position higher than the axis of the intermediate shaft 125 and firer to a position slightly higher than the axis of the hammer bit 119. A stem 163*c* is founts on the extending end of each of the arms 163*b* and protrudes generally horizontally outward. The stem 163*c* is rotatably supported by a front support plate (not shown) on the gear housing 107 and a rear support plate 107*b* disposed on the inner housing 107*a* of the gear housing 107. Further, a weight concentration part 163*e* for concentrating the weight is provided genially in the middle of the arms 163*b* of the counter weight 163 in the extending direction. With this weight concentration part 163*e*, the center of gravity of the counter weight 163 is located nearer to the axis of the hanker bit 119 than that of the counter weight 153 of the fist embodiment.

According to this embodiment, like the first embodiment, in the processing operation, the counter weight 163 serves to reduce impulsive and cyclic vibration caused in the axial direction of the hammer bit 119. The counter weight 163 is connected to the swinging ring 129 in a position shifted about 180° from the connection between the swinging ring 129 and the cylindrical piston 141 in the circumferential direction. Therefore, when the cylindrical piston 141 slides within the cylinder 135 toward the striker 143, the counter weight 163 rotates in a direction opposite to the sliding direction of the striker 143. Specifically, according to this embodiment, when the cylindrical piston 141 linearly moves toward the striker 143, and the hammer bit 119 is caused to perform a striking movement via the striker 143 and the impact bolt 145, the counter weight 163 rotates on the stem 163*c* in a direction opposite to the cylindrical piston 141 in the longitudinal direction of the hammer bit 119. In this manner, vibration caused in the hammer drill 101 in the axial direction of the hammer bit 119 can be reduced.

In this embodiment, as described above, the weight concentration part 163*e* is provided on the arms 163*b* of the counter weight 163, so that the center of gravity of the counter weight 163 is located nearer to the same level as a horizontal plane including the axis of the hammer bit 119. As a result, unnecessary vibration can be reduced which may be caused by a couple around the horizontal axis that intersects with the axis of the intermediate shaft 125 when the cylindrical piston 141 and the counter weight 163 are driven by the swinging ring 129 in opposite directions.

When the counter weight 163 rotates on the stem 163*c* in the axial direction of the hammer bit 119, the counter weight 163 moves by a displacement X in the vertical direction that intersects with the axial direction of the hammer bit 119. In such a case, because the pivot point of the counter weight 163 is located at a higher position than the axis of the hammer bit 119, the vertical displacement X of the rotating counter weight 163 can be reduced. Therefore, the occurrence of unnecessary vibration by the vertical displacement can be reduced.

Third Representative Embodiment

Figure 8:
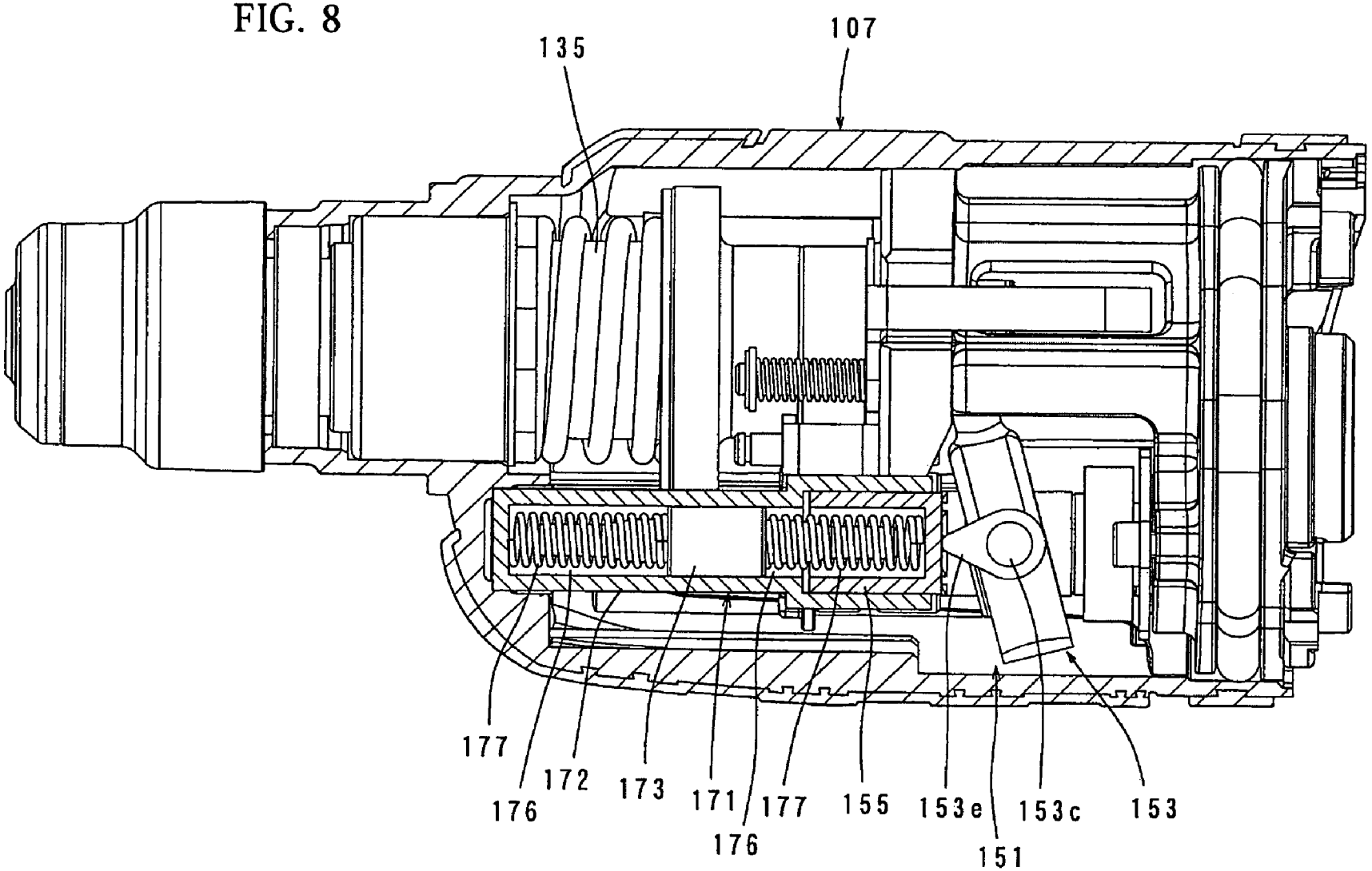
FIG. 8 is a side view showing an internal mechanism within the gear housing according to a third representative embodiment of the invention.
Figure 9:
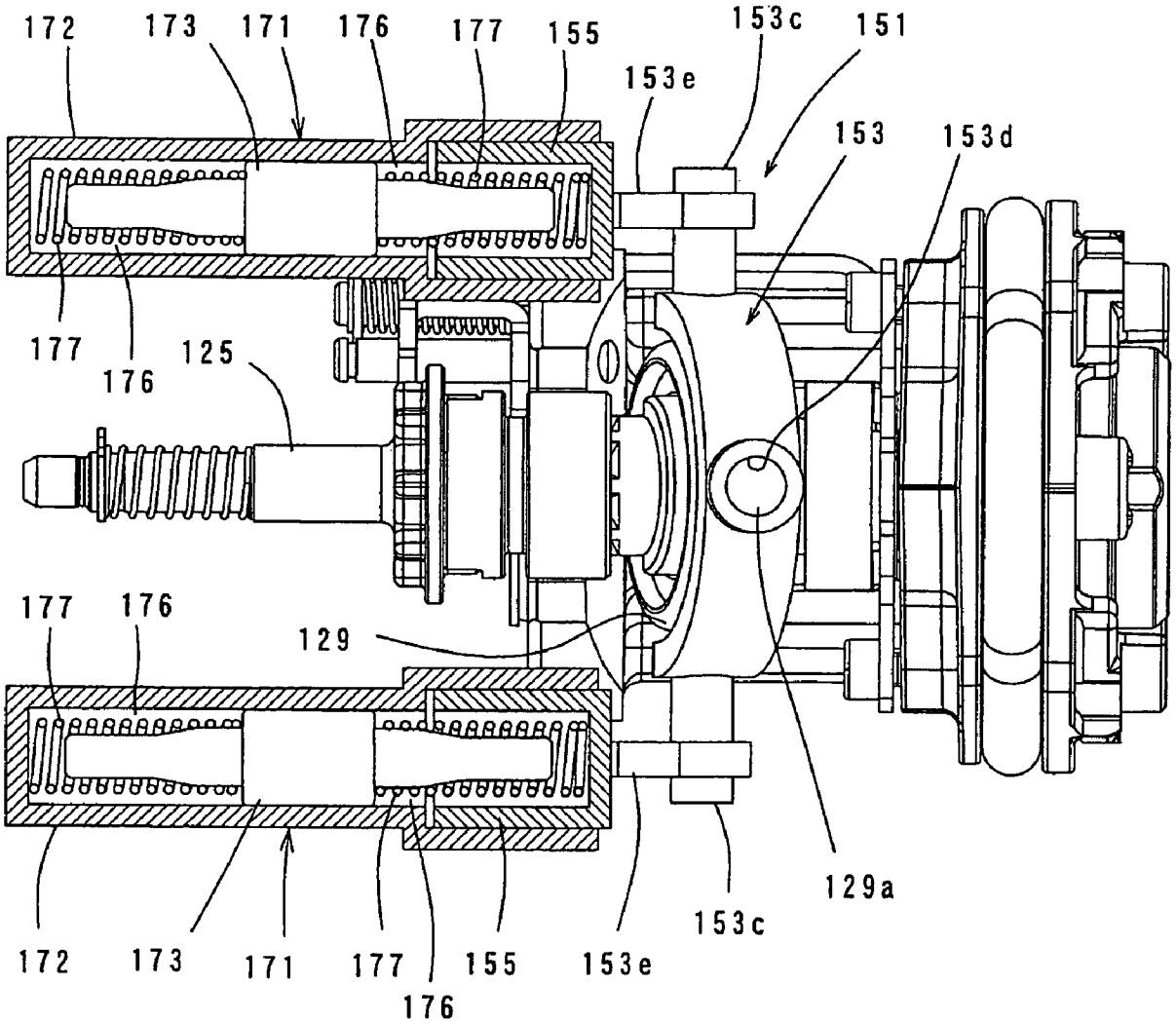
FIG. 9 is a bottom view also showing the internal mechanism within the gear housing, with a dynamic vibration reducer shown in section.
Figure 10:
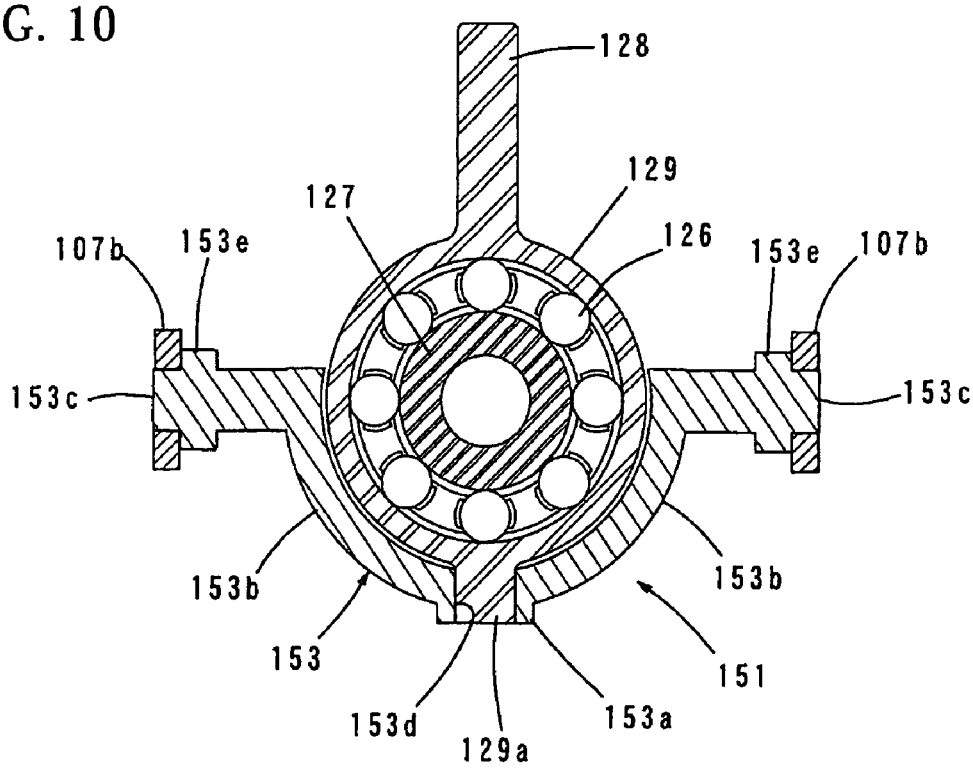
FIG. 10 is a sectional view of the vibration reducing mechanism part.
Figure 11:
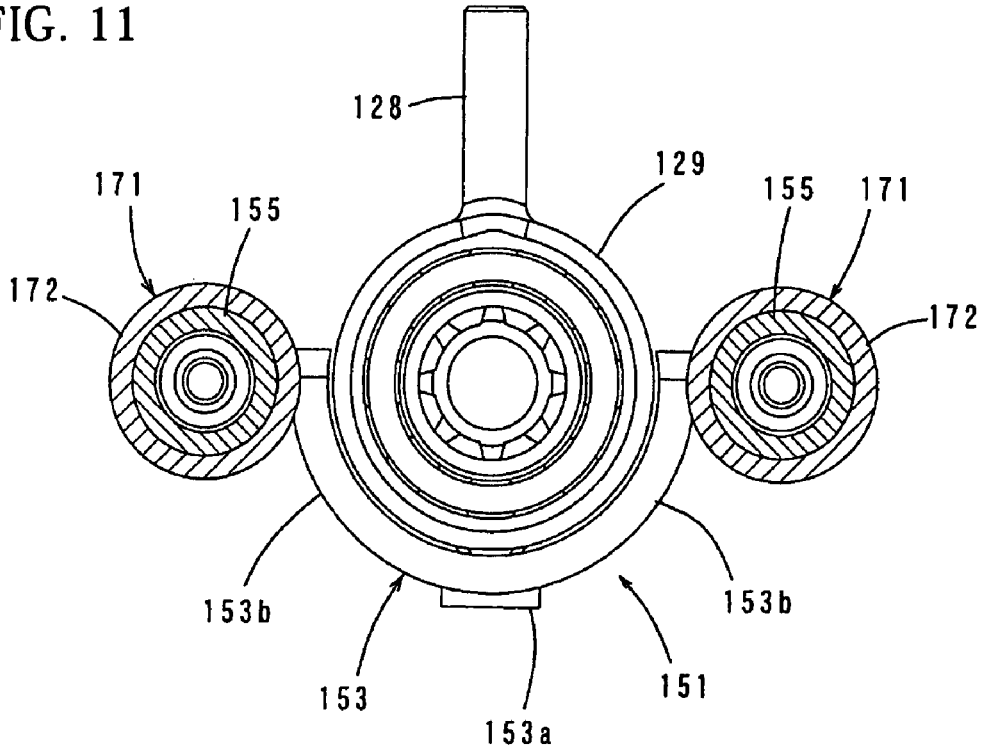
FIG. 11 is an external view of the vibration reducing mechanism part, with the dynamic vibration reducer shown in section.
Figure 12:
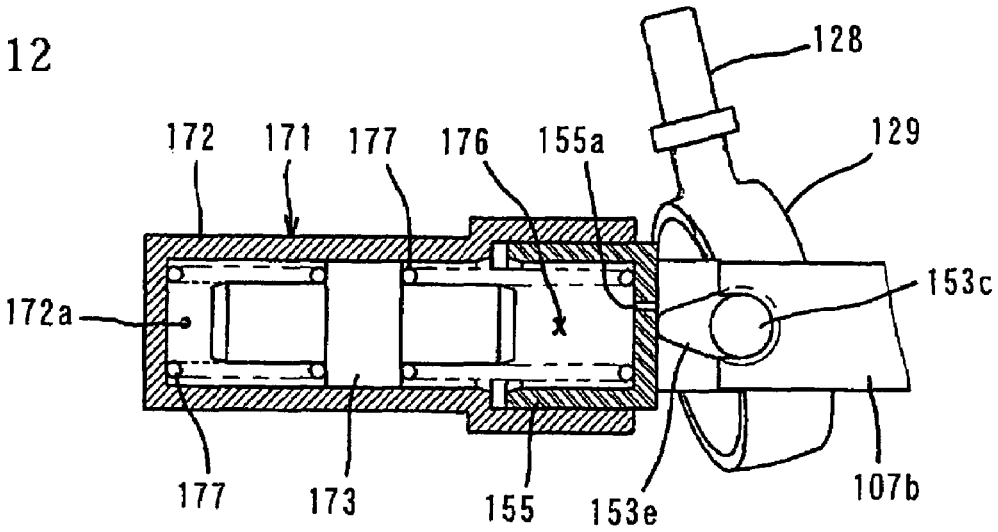
FIG. 12 is a view for explaining forcible excitation of the dynamic vibration reducer, with a biasing spring shown under maximum pressure.
Figure 13:
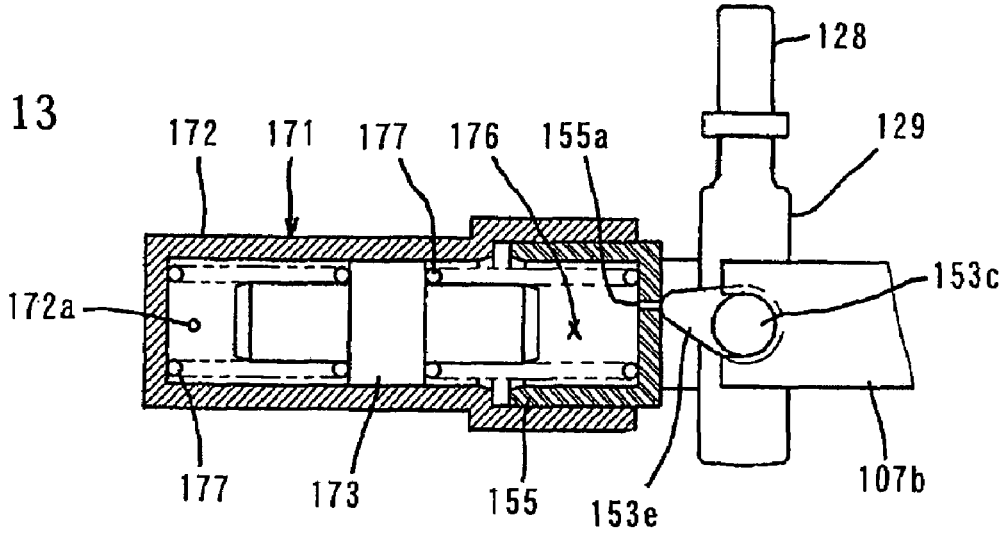
FIG. 13 is a view for explaining forcible excitation of the dynamic vibration reducer, with the biasing spring shown under medium pressure.
Figure 14:
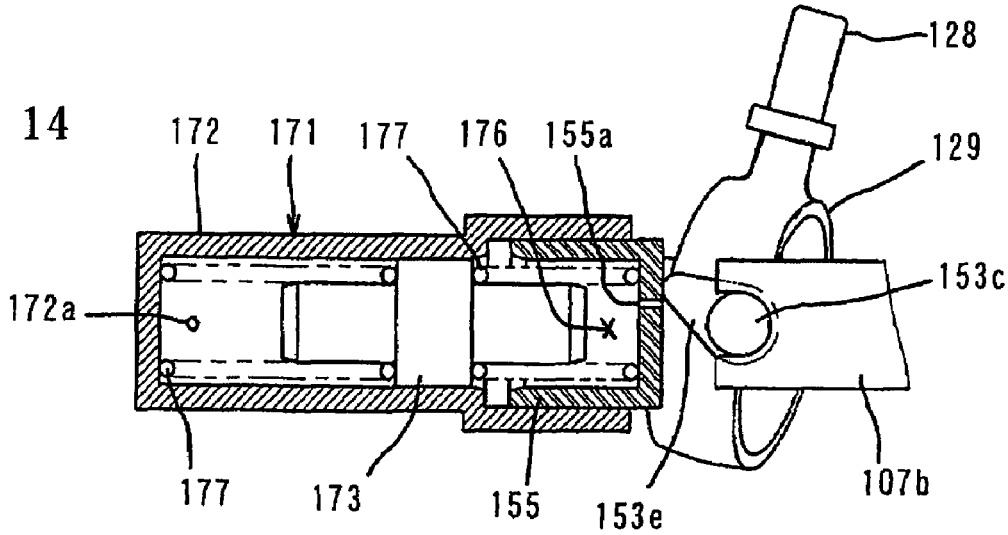
FIG. 14 is a view for explaining forcible excitation of the dynamic vibration reducer, with the biasing spring shown under no pressure.

Third representative embodiment of the present invention is now explained with reference to FIGS. 8 to 14. The vibration reducing mechanism 151 according to this embodiment uses the counter weight 153 and a dynamic vibration reducer 171 together. FIGS. 8 and 9 show an internal mechanism disposed within the gear housing 107, with the dynamic vibration reducer 171 shown in section. As shown in FIGS. 8 and 9, the dynamic vibration reducers 171 are disposed within the gear housing 107. The dynamic vibration reducers 171 are disposed on the right and left sides of the axis of the hammer bit 119 in the side region of the gear housing 107 of the hammer drill 101 (see FIG. 9). The right and left dynamic vibration reducers 171 have the same construction. Further, FIG. 10 is a sectional view of the vibration reducing mechanism part, and FIG. 11 is an external view of the vibration reducing mechanism part (with the dynamic vibration reduces 171 shown in section). FIGS. 12 to 14 show the construction and movement of the dynamic vibration reducer 171 in detail. However, in FIGS. 12 to 14, the counter weight 153 is not shown except the stem 153*c*.

In this embodiment, the dynamic vibration reducer 171 includes a cylindrical body 172 that extends in the axial direction of the hammer bit 119, a vibration-reducing weight 173 disposed within the cylindrical body 172, and biasing springs 177 disposed on the front and rear sides of the weight 173. Each of the biasing springs 177 is a feature that corresponds to the "elastic element" according to the present invention. The biasing springs 177 exert a spring force on the weight 173 toward each other when the weight 173 moves in the longitudinal direction of the cylindrical body 172 (in the axial direction of the hammer bit 119). Further, an actuation chamber 176 is defined on the both sides of the weight 173 within the cylindrical body 172 of the dynamic vibration reducer 171. The actuation chamber 176 communicates with the outside of the dynamic vibration reducer 171 via a vent 172*a* (see FIGS. 12 to 14) formed through the wall of the cylindrical body 172 or via a vent 155*a* (see FIGS. 12 to 14) formed through a slider 155 which will be described below. Thus, the actuation chamber 176 is normally in communication with the outside so that air can freely flow in and out. Therefore, the air flow doe not interfere with the reciprocating movement of the weight 173.

The counter weight 153 not only has a function of reducing vibration, but also inputs an excitation force in order to actively drive and forcibly excite the weight 173 of the dynamic vibration reducer 171. Specifically, in addition to the construction described in the first embodiment, an operating piece 153*e* is provided on the protruding end of each of the stems 153*c* of the counter weight 153 and rotates together with the associated stem 153*c*. The operating piece 153*e* protrudes forward, and the protruding end of the operating piece 153*e* is in contact with the back of the slider 155 which is slidably disposed within the cylindrical body 172 of the dynamic vibration reducer 171. The slider 155 supports one end of one of the biasing springs 177. Therefore, when the counter weight 153 rotates toter with the stem 153*c*, the operating piece 153*e* rotates together with the associated stem 153*c*, and the protruding end of tie operating piece 153*e* moves the slider 155 in a direction of pressing the biasing spring 177. Further, the counter weight 153 has the same construction as in the first embodiment, and is therefore given the same numeral and will not be described.

Further, the slider 155 has a cylindrical shape elongated in the direction of movement and having a closed end in the direction of movement. Therefore, the slider 155 can have a wider sliding contact area without increasing the longitudinal length of the cylindrical body 172. Thus, the movement of the slider 155 in the longitudinal direction can be stabilized.

In the third embodiment constructed as described above, in the processing operation, not only the counter weight 153 serves to reduce impulsive and cyclic vibration caused in the axial direction of the hammer bit 119 like in the first embodiment, but also the dynamic vibration reducer 171 disposed in the body 103 has a vibration reducing function. Specifically, the weight 173 and the biasing springs 177 serve as vibration reducing elements in the dynamic vibration reducer 171 and cooperate to passively reduce vibration of the body 103 of the hammer drill 101 on which a predetermined external force (vibration) is exerted. In this manner, vibration of the hammer drill 101 can be effectively reduced.

Further, when the hammer drill 101 is driven, the cylindrical piston 141 linearly moves toward the striker 143 by swinging movement of the swinging ring 129, and the hammer bit 119 is caused to perform a striking movement via the striker 143 and the impact bolt 145. At this time, like in the first embodiment, the counter weight 153 rotates on the stem 153*c* in a direction opposite to the cylindrical piston 141 in the axial direction of the hammer bit 119. In this manner, vibration caused in the hammer drill 101 in the axial direction of the hammer bit 119 can be reduced.

Further, when the counter weight 153 rotates on the stems 153*c* in the axial direction of the hammer bit 119, as shown in FIGS. 12 to 14, the operating piece 153*e* on the counter weight 153 vertically rotates. When the operating piece 153*e* rotates in one direction (downward in this embodiment), the operating piece 153*e* linearly moves the slider 155 of the dynamic vibration reducer 171 and presses the biasing spring 177, which in turn moves the weight 173 in the direction of pressing the biasing spring 177. Specifically, the weight 173 can be actively driven and forcibly excited. Therefore, the dynamic vibration reducer 171 can be steadily operated regardless of the magnitude of vibration which acts upon the hammer drill 101. As a result, the hammer drill 101 can ensure a sufficient vibration reducing function by actively driving the weight 173 even when, for example, a user performs a hammering operation or a hammer drill option while applying a strong pressing force to the hammer drill 101, or even in such operating conditions in which, although vibration reduction is highly required, the vibration magnitude inputted to the dynamic vibration reducer 171 may be reduced due to the pressing force so that the dynamic vibration reducer 171 cannot sufficiently function.

As described above, according to this embodiment, the counter weigh 153 and the dynamic vibration reducer 171 are used in combination. Therefore, with both the vibration reducing functions of the counter weigh 153 and the dynamic vibration reducer 171, a further higher vibration reducing effect can be obtained.

Particularly in this embodiment, the operating piece 153*e* is disposed on the counter weight 153 provided for vibration reduction, and the operating piece 153*e* drives the slider 155 and inputs an excitation force to the dynamic vibration reducer 171. With this construction, it is not necessary to additionally provide an operating mechanism specifically designed as a means for inputting the excitation force, so that simplification in structure can be attained.

Fourth Representative Embodiment

Figure 15:
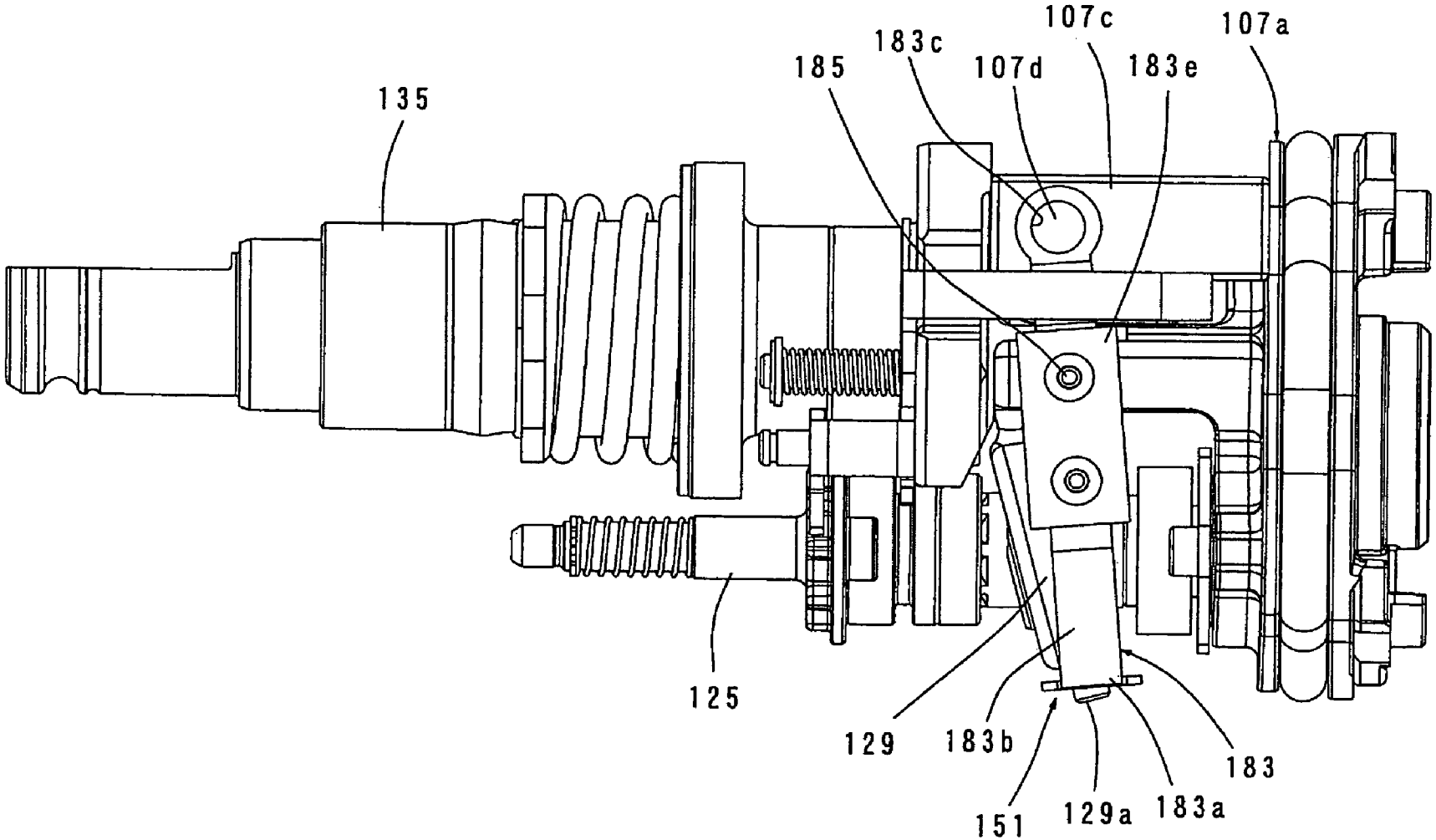
FIG. 15 is a side view showing an internal mechanism within the gear housing according to a fourth representative embodiment of the invention.
Figure 16:
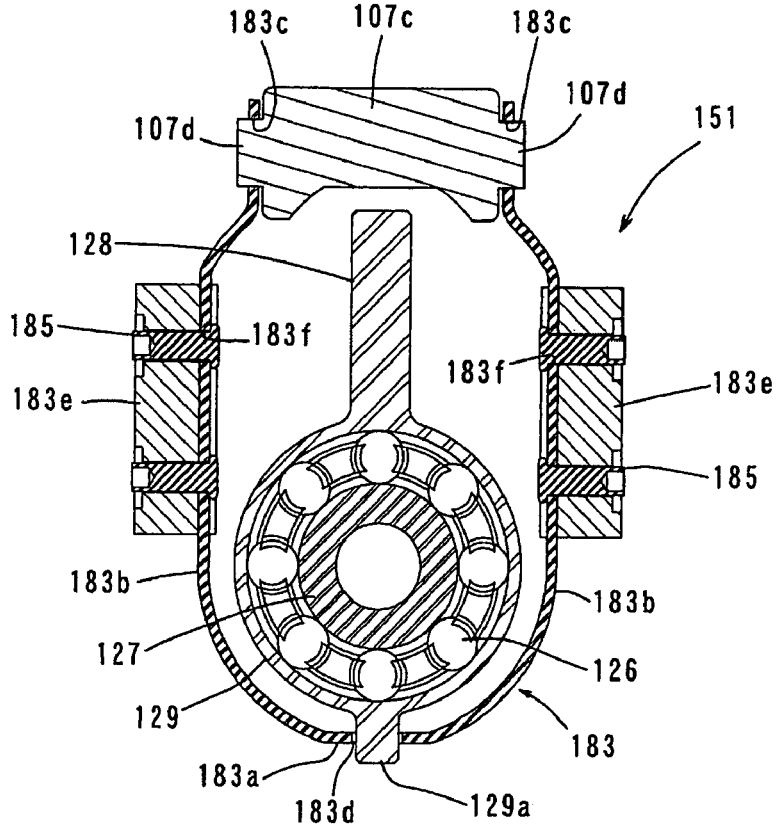
FIG. 16 is a sectional view of the vibration reducing mechanism part.
Figure 17:
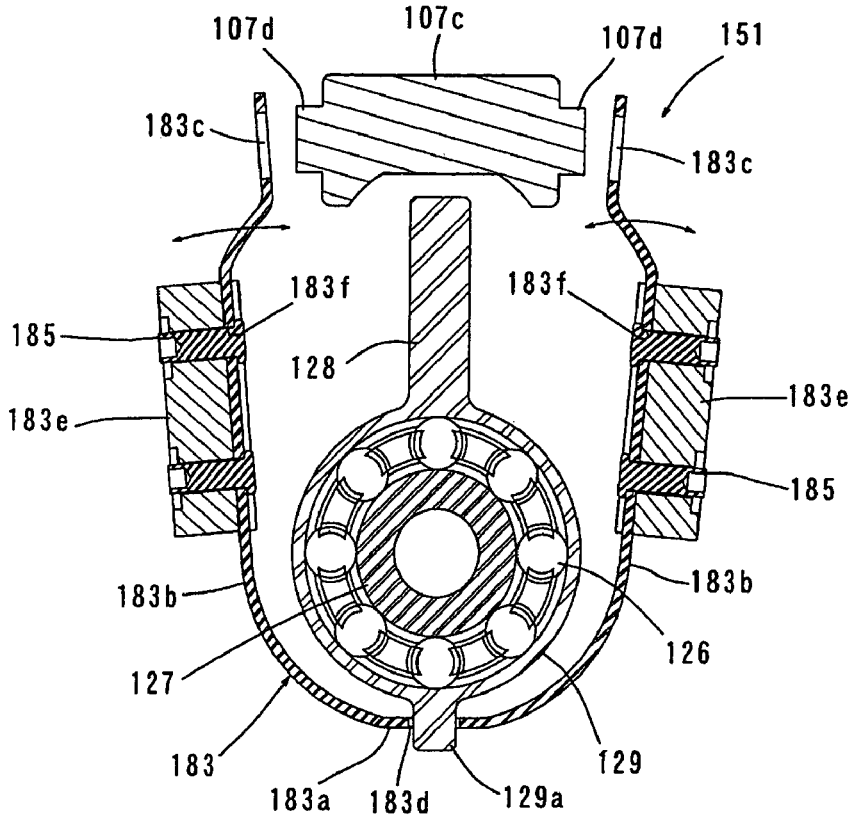
FIG. 17 is a sectional view of the vibration reducing mechanism part, showing the assembling procedure of a counter weight.

The vibration reducing mechanism 151 according to a fourth representative embodiment of the present invention is now explained with reference to FIGS. 15 to 17. FIG. 15 shows an internal mechanism disposed within the gear housing 107. FIGS. 16 and 17 are sectional views of the vibration reducing mechanism part. FIG. 17 shows the assembling procedure of the vibration reducing mechanism part. Like in the first and second embodiments, the vibration reducing mechanism 151 of the fourth embodiment also includes a counter weight 183 which is driven by the swinging ring 129. Except for the counter weight 183, the fourth embodiment has the same construction as the first embodiment. Components or elements in the fourth embodiment which are substantially identical to those in the first embodiment are given like numerals as in the first embodiment and will not be described. The counter weight 183 is a feature that corresponds to the "counter weight" according to the present invention.

As shown in FIG. 16, the counterweight 183 includes right and left arms 183*b* and right and left weight concentration parts 183*e*. A lower end portion 183*a* of the counter weight 183 is connected to the swinging ring 129, and in this state, the arms 183*b* extend upward. The weight concentration parts 183*e* are provided on the arms 183*b* and serve as a vibration reducing weight. The counter weight 163 is generally U-shaped as viewed from the front or the back of the hammer drill 101. In this embodiment, the arms 183*b* and the weight concentration parts 183*e* are formed as separate members. The arms 183*b* and the weight concentration parts 183*e* are features that correspond to the "connecting part" and the "weight part", respectively, according to the present invention.

A circular engagement hole 183*d* is firmed in the lower end portion 183*a* of the alms 183*b*. The protrusion 129*a* extends downward from the lower end region of the swinging ring 129 and is loosely engaged in the engagement hole 183*d* for free relative movement. Thus, the arms 183*b* are connected to the swinging ring 129. Further, the arms 183*b* extend upward past the side of the swinging rig 129 and to a position slightly higher than the axis of the hammer bit 119. A circular stem hole 183*c* is formed through the extending end portion of each of the arms 183*b*. The stem holes 183*c* are rotatably engaged with stems (bosses) 106*d* of a weight supporting portion 107*c* formed on the inner housing 107*a*. Thus, the counter weight 183 can rotate on the stems 106*d* in the axial direction of the hammer bit 119. The stems 106*d* and the stem holes 183*c* are features that correspond to the "stem" and the "hole", respectively, according to the present invention.

The arms 183*b* are shaped into a predetermined fom, or generally U-shaped having the engagement hole 183*a* in the lower end portion 183*a*, the stem holes 183*c* in the extending end portions of the arms, and a plurality of weight mounting holes 183*f* generally in the middle of the arms in the extending diction, by sheet metal processing such as cutting, bending and hole making. The distance between the opposed extending end portions of the arms 183*b* can be changed by elastic deformation of the arms 183*b*. Therefore, assembly of the counter weight 183 to the weight supporting portion 107*c* of the inner housing 107*a*, or engagement of the stem holes 183*c* of the arms 183*b* with the stems 106*d* of the weight supporting portion 107*c* can be achieved by utilizing deformation of the arms 183*b* as shown in FIG. 17. The weight concentration parts 183*e* are shaped, for example, into a rectangular block by casting and fastened to the arms 183*b* using fastening means such as rivets 185 through the weight mounting holes 183*f* in the arms 183*b*.

According to the fourth embodiment constructed as described above, in hammering operation using the hammer drill 101, the counter weight 183 performs a function to reduce impulsive and cyclic vibration caused in the axial direction of the hammer bit 119. Thus, the same vibration-reducing effect can be obtained with the vibration reducing mechanism 151 as in the first and second embodiments.

According to the fourth embodiment, the arms 183*b* and the weight concentration parts 183*e* are formed as separate members. Therefore, in manufacturing the counter weight 183, the shapes and configurations of the arms 183*b* and the weight concentration parts 183*e* can be properly set individually in consideration of individual functions.

The arms 183*b* to transmit the movement of the swinging ring 129 to the counter weight 183 is formed by sheet metal processing, so that the arms 183*b* can be made thinner and thus lighter in weight while ensuing the strength required to transmit the movement of the swinging ring 129. As for the weight concentration parts 183*e*, the weight required to reduce vibration caused during operation can be readily ensured. As a result, the vibration reducing effect can be optimized while the counterweight 183 is reduced in weight as a whole. Further, by mass reduction of the component parts other than the weight concentration parts 183*e*, unnecessary vibration can be reduced which may be caused by movement of the counter weight 183. Further, the manufacturing cost of the counter weight 183 can be reduced with the arms 183*b* made of sheet metal.

Further, according to the fourth embodiment, the arms 183*b* can be assembled to the stems 106*d* of the weight supporting portion 107*c* on the body side by utilizing deformation of the arms 183*b*. Specifically, a biasing force is applied to the arms 183*b* in a direction that widens the distance between the opposed arms 183*b*, and the stem holes 183*c* are aligned to the stems 107*c*. Thereafter, the force is released, so that the stem holes 183*c* can be fitted onto the stems 106*d*. Thus, the assembling operation can be easily performed. Further, with the construction in which the counter weight 183 is assembled by utilizing deformation of the arms 183*b*, the counter weight 183 as a whole can be made compact. Further, the arms 183*b* forming the stem holes 183*c* need not have a two-part structure having front and rear section&. Thus, simplification in structure can be attained.

Further, in the above-described embodiments, the swinging ring 129 of the swinging mechanism is described as being supported for relative rotation at a predetermined inclination angle by the intermediate shaft 125 and caused to swing in the axial direction of the intermediate shaft 125 when the intermediate shaft 125 rotates. However, the construction of the swinging mechanism is not limited to this. Specifically, the swinging ring 129 may be mounted such that it is inclined at a predetermined angle with respect to the axis of the intermediate shaft and rotates together with the intermediate shaft. Thus, the swinging mechanism may be constructed such that the swinging ring is caused to swing in the axial direction while rotating together with the intermediate shaft when the intermediate shaft rotates. Further, in the above-described embodiments, the hammer drill 101 is described as an representative example of the power impact toot but the present invention can be applied not only to the hammer drill 101 but also to a hammer which performs only hammering operation.

Further, in the fourth embodiment, the stem holes 183 may be formed on the arm support portion 107*c* side, and the stems 106*d* on the arms 183*b* side.

Description of Numerals

| | |
|---|---|
| 101 | hammer drill (power impact tool) |
| 103 | body |
| 105 | motor housing |
| 107 | gear housing |
| 107a | inner housing |
| 107b | support plate |
| 107c | arm supporting portion |
| 107d | stem |
| 109 | handgrip |
| 109a | trigger |
| 111 | driving motor |
| 113 | motion converting mechanism |
| 114 | power transmitting mechanism |
| 115 | striking mechanism |
| 119 | hammer bit (tool bit) |
| 121 | driving gear |
| 123 | driven gear |
| 124 | engaging member |
| 125 | intermediate shaft (rotating shaft) |
| 126 | bearing |
| 127 | rotating element |
| 128 | swinging rod |
| 129 | swinging ring (swinging member) |
| 129a | protrusion |
| 131 | first transmission gear |
| 133 | second transmission gear |
| 135 | cylinder |
| 137 | tool holder |
| 141 | cylindrical piston |
| 141a | air chamber |
| 143 | striker |
| 145 | impact bolt |
| 151 | vibration reducing mechanism |
| 153 | counter weight |
| 153a | lower end portion |
| 153b | arm |
| 153c | stem (pivot point) |
| 153d | engagement hole |
| 153e | operating piece |
| 155 | slider |
| 155a | vent |
| 163 | counter weight |
| 163a | lower end portion |
| 163b | arm |
| 163c | stem (pivot point) |
| 163d | engagement hole |
| 163e | weight concentration part |
| 171 | dynamic vibration reducer |
| 172 | cylindrical body |
| 172a | vent |
| 173 | weight |
| 176 | actuation chamber |

-continued

| | |
|---|---|
| 177 | biasing spring (elastic element) |
| 183 | counter weight |
| 183a | lower end portion |
| 183b | arm (connecting part) |
| 183c | stem hole (hole) |
| 183d | engagement hole |
| 183e | weight concentration part (weight part) |
| 183f | weight mounting hole |
| 185 | rivet |

What we claim is:

1. A power impact tool to perform a predetermined operation on a workpiece by using a striking movement of a tool bit in its axial direction comprising:

a motor, a rotating shaft that is disposed substantially parallel to the axial direction of the tool bit and rotationally driven by the motor, a swinging member that is supported by the rotating shaft to swing in the axial direction of the rotating shaft by rotation of the rotating shaft, the swinging member having an upper end region and a lower end region, as viewed in the axial direction of the tool bit, the upper end region extending in a direction substantially perpendicular to the axial direction of the rotating shaft, a tool driving mechanism that is connected to the upper end region of the swinging member, the tool driving mechanism linearly moving in the axial direction of the tool bit by the swinging movement of the swinging member to linearly drive the tool bit, and a counter weight that reduces vibration caused in the axial direction of the tool bit during the operation of the power impact tool, wherein:

the counter weight is disposed in a region higher than the lower end region of the swinging member, as viewed from the axial direction of the tool bit, and a lower end of the counter weight is connected to the lower end region of the swinging member and the counter weight extends upward from the connection between the counter weight and the swinging member and has a pivot point in an extending end portion, and when the swinging member swings, the counter weight is driven by the swinging member to pivot about the pivot point in the axial direction of the tool bit, thereby reducing vibration caused in the axial direction of the tool bit.

2. The power impact tool as defined in claim 1, wherein the pivot point is disposed at a position above the axis of the tool bit in the direction substantially perpendicular to the axial direction of the rotating shaft.

3. The power impact tool as defined in claim 1, wherein the counter weight includes a connecting part connected to the swinging member and extending upward and a weight part defining a vibration reducing weight, the connecting part and the weight part being provided as separate members and thereafter integrally formed with each other.

4. The power impact tool as defined in claim 1, wherein:

the counter weight includes a connecting part connected to the swinging member and extending upward and a weight part defining a vibration reducing weight, the connecting part and the weight part being provided as separate members and thereafter integrally formed with each other, the connecting part includes a right arm and a left arm with respect to a longitudinal axis of the tool, the right and left arms respectively extending upward from the lower end connected to the swinging member and past the side of the swinging member, a lateral distance between the extending end portions of the arms is provided as changeable by using elastic deformation of the arms, the pivot point includes a stem that extends in a direction that intersects with the extending direction of the arms and a hole that is fitted onto the stem for relative rotation, and one of the stem and the hole is formed in the extending end portion of each of the arms, and the stem and the hole are engaged with each other by utilizing a movement of changing the distance between the arms by deformation of the arms.

5. The power impact tool as defined in claim 1 further comprising a dynamic vibration reducer that reduces vibration caused during the operation of the tool bit, the dynamic vibration reducer including a weight that is allowed to reciprocate in the axial direction of the tool bit with a biasing force of an elastic element being applied to the weight, wherein the counter weight drives the weight of the dynamic vibration reducer via the elastic element when the counter weight rotates.

6. The power impact tool as defined in claim 1, wherein the counter weight is substantially U-shaped having an open top, as viewed from the axial direction of the tool bit, and the counter weight is disposed on an outside of the swinging member in such a manner as to cover the swinging member.

7. The power impact tool as defined in claim 1, wherein the counter weight is substantially U-shaped having an open top, as viewed from the axial direction of the tool bit, and the counter weight is disposed on an outside of the swinging member in such a manner as to cover the swinging member, and wherein a weight concentration part for concentrating the weight is provided generally in a middle of the counter weight in the direction substantially perpendicular to the axial direction of the rotating shaft.

8. The power impact tool as defined in claim 1, wherein the counter weight is substantially U-shaped having an open top, as viewed from the axial direction of the tool bit, and the counter weight is disposed on an outside of the swinging member in such a manner as to cover the swinging member, and wherein the counter weight and the swinging member are connected to each other via a protrusion formed on one of the counter weight and the swinging member and an engagement hole formed on the other of the counter weight and the swinging member, the protrusion being loosely engaged in the engagement hole for free relative movement.

9. The power impact tool as defined in claim 1, wherein:

the counter weight includes a connecting part connected to the swinging member and extending upward and a weight part defining a vibration reducing weight, the connecting part and the weight part being provided as separate members and thereafter integrally formed with each other, and the connecting part is formed by sheet metal that is bent substantially into a U shape having an open top, as viewed from the axial direction of the tool bit.

10. A power impact tool to perform a predetermined operation on a workpiece by using a striking movement of a tool bit in its axial direction comprising:

a motor, a rotating shaft that is disposed substantially parallel to the axial direction of the tool bit and rotationally driven by the motor, a swinging member that is supported by the rotating shaft to swing in the axial direction of the rotating shaft by rotation of the rotating shaft, the swinging member having an upper end region and a lower end region, as viewed in the axial direction of the tool bit, the upper end region extending in a direction substantially perpendicular to the axial direction of the rotating shaft, a tool driving mechanism that is connected to the upper end region of the swinging member, the tool driving mechanism linearly moving in the axial direction of the tool bit by the swinging movement of the swinging member to linearly drive the tool bit, and a counter weight that reduces vibration caused in the axial direction of the tool bit during the operation of the power impact tool, wherein:

the counter weight is disposed in a region higher than the lower end region of the swinging member, as viewed in the axial direction of the tool bit, and a lower end of the counter weight is connected to the lower end region of the swinging member, the counter weight extends upward from the connection between the counter weight and the swinging member and has a pivot point in an extending end portion, and when the swinging member swings, the counter weight is driven by the swinging member to pivot about the pivot point in the axial direction of the tool bit, thereby reducing vibration caused in the axial direction of the tool bit, and the counter weight includes a connecting part connected to the swinging member and extending upward and a weight part defining a vibration reducing weight, the connecting part and the weight part being provided as separate members and thereafter integrally formed with each other.

11. A power impact tool to perform a predetermined operation on a workpiece by using a striking movement of a tool bit in its axial direction comprising:

a motor, a rotating shaft that is disposed substantially parallel to the axial direction of the tool bit and rotationally driven by the motor, a swinging member that is supported by the rotating shaft to swing in the axial direction of the rotating shaft by rotation of the rotating shaft, the swinging member having an upper end region and a lower end region, as viewed in the axial direction of the tool bit, the upper end region extending in a direction substantially perpendicular to the axial direction of the rotating shaft, a tool driving mechanism that is connected to the upper end region of the swinging member, the tool driving mechanism linearly moving in the axial direction of the tool bit by the swinging movement of the swinging member to linearly drive the tool bit, and a counter weight that reduces vibration caused in the axial direction of the tool bit during the operation of the power impact tool, wherein:

the counter weight is disposed in a region higher than the lower end region of the swinging member, as viewed in the axial direction of the tool bit, and a lower end of the counter weight is connected to the lower end region of the swinging member, the counter weight extends upward from the connection between the counter weight and the swinging member and has a pivot point in an extending end portion, and when the swinging member swings, the counter weight is driven by the swinging member to pivot about the pivot point in the axial direction of the tool bit, thereby reducing vibration caused in the axial direction of the tool bit, and the counter weight includes a connecting part connected to the swinging member and extending upward and a weight part defining a vibration reducing weight, the connecting part and the weight part being provided as separate members and thereafter integrally formed with each other, the connecting part includes a right arm and a left arm with respect to a longitudinal axis of the tool, the right and left arms respectively extending upward from the lower end connected to the swinging member and past the side of the swinging member, a lateral distance between the extending end portions of the arms is provided as changeable by using elastic deformation of the arms, the pivot point includes a stem that extends in a direction that intersects with the extending direction of the arms and a hole that is fitted onto the stem for relative rotation, and one of the stem and the hole is formed in the extending end portion of each of the arms, and the stem and the hole are engaged with each other by utilizing a movement of changing the distance between the arms by deformation of the arms.

* * * * *